United States Patent [19]

Jorroch et al.

[11] Patent Number: 4,846,737

[45] Date of Patent: Jul. 11, 1989

[54] MULTIPLE POLE COUPLING FOR ELECTRICAL LINES

[75] Inventors: Waldemar Jorroch; Peter Schekalla, both of Wuppertal, Fed. Rep. of Germany

[73] Assignee: Kabelwerke Reinshagen GmbH, Fed. Rep. of Germany

[21] Appl. No.: 258,025

[22] Filed: Oct. 14, 1988

[30] Foreign Application Priority Data

Oct. 17, 1987 [DE] Fed. Rep. of Germany ..... 3735205

[51] Int. Cl.[4] ..... H01R 13/436

[52] U.S. Cl. ..... 439/752; 439/686

[58] Field of Search ..... 439/686, 695, 701, 733, 439/752, 869

[56] References Cited

U.S. PATENT DOCUMENTS

| | | | |
|---|---|---|---|
| 4,113,333 | 9/1978 | Horowitz | 439/752 |
| 4,284,320 | 8/1981 | Nix et al. | 439/752 |
| 4,698,030 | 10/1987 | Ryll et al. | 439/752 |

FOREIGN PATENT DOCUMENTS

| | | | |
|---|---|---|---|
| 3537722 | 4/1987 | Fed. Rep. of Germany | 439/752 |
| 3023313 | 10/1987 | Fed. Rep. of Germany . | |

*Primary Examiner*—Gary F. Paumen

*Attorney, Agent, or Firm*—Reising, Ethington, Barnard, Perry & Milton

[57] ABSTRACT

A multiple pole coupling for electrical lines is disclosed in which plural contact elements are mounted in longitudinal passages in a coupling body. A first housing with a base plate and cover plate receives a slide with a set of slide passages therein for receiving contact elements. A set of base plate passages and a corresponding set of cover plate passages are disposed in the same pattern as the slide passages but the cover plate passages are laterally offset from the base plate passages. The slide is disposed in the housing in a first position with the passages therein being aligned respectively with the corresponding base plate passages. Each contact element extends through a base plate passage and is disposed partially in the base plate passage and partially in the corresponding slide passage. Each of the contact elements has a laterally extending abutment shoulder and each of the base plate passages has an enlarged portion adjacent the part of the contact element disposed therein. The slide is movable in the housing from the first position to a second position in which the aforesaid part of the contact element is disposed in the enlarged portion of the passage and in which the passages in the slide are aligned respectively with the cover plate passages. Also, in the second position, each of the abutment shoulders overlies a part of the base plate whereby the contact elements are held captive in the passages.

12 Claims, 4 Drawing Sheets

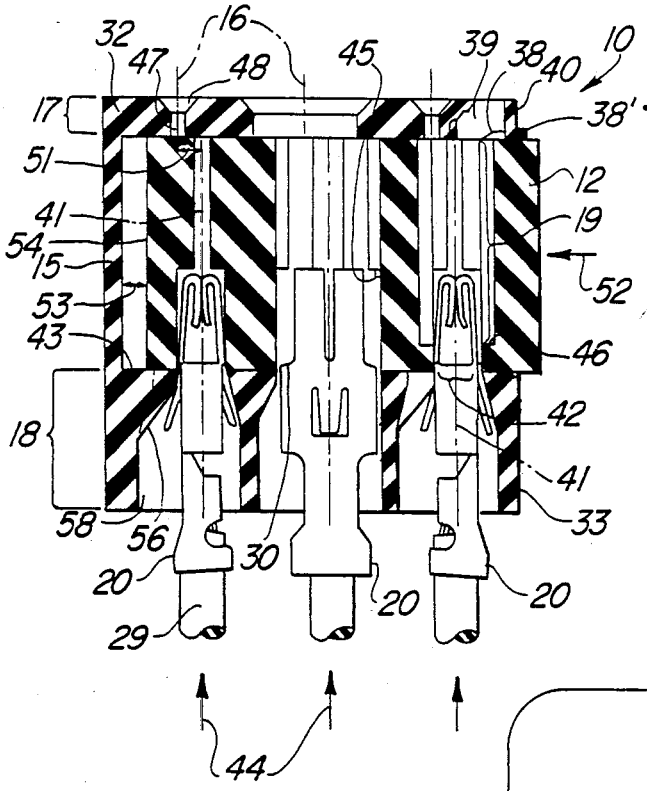
Fig-4
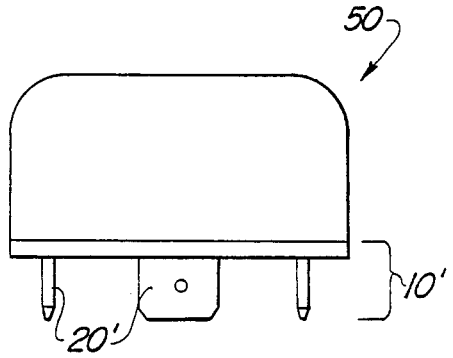
Fig-5
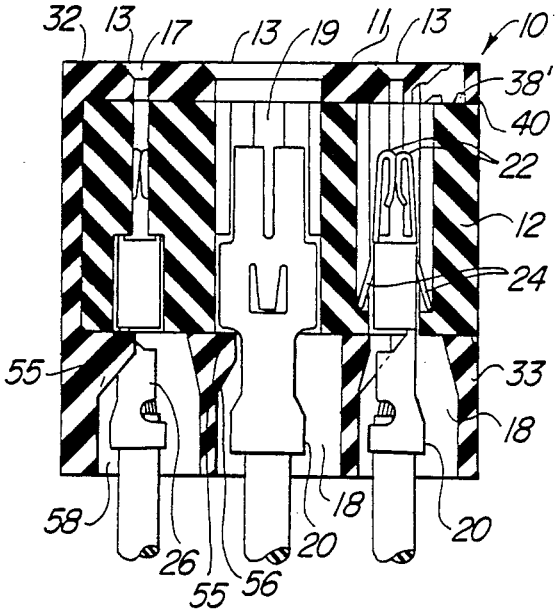

MULTIPLE POLE COUPLING FOR ELECTRICAL LINES

FIELD OF THE INVENTION

This invention relates to electrical couplings and more particularly to a multiple pole coupling for electrically connecting complementary electrical contact elements.

SUMMARY OF THE INVENTION

An electrical coupling is provided in which a plurality of electrical contact elements are disposed in separate passages in a coupling body and adapted for electrical connection by complementary contact elements held by a complementary coupling member. According to the invention, the contact elements are held in such a manner that any improper placement or positioning is readily discerned during assembly during usage. Proper placement prior to final assembly is assured and, according to the invention, is retained during usage.

The multiple pole coupling of the invention comprises a first housing member with a base plate and cover plate and a recess therebetween which opens on one side of the housing member. A set of base plate passages and corresponding set of cover plate passages extend longitudinally through the respective base plate and cover plate and the sets of passages are disposed in the same pattern but are laterally offset from each other. A second housing member includes a slide member with a set of slide member passages extending therethrough and disposed in the same pattern as that of the base plate and cover plate passages. The slide member is disposed in the recess of the first housing member in a first position with the slide member passages aligned respectively with the corresponding base plate passages. A contact element is disposed partially in one of said base plate passages and partially in the corresponding one of the slide member passages and the contact element is provided with a laterally extending abutment member. Each of the base plate passages has an enlarged portion adjacent that part of the respective contact element disposed therein. The slide member is movable in the recess from the first position to a second position in which the aforesaid part of the contact element is disposed in enlarged portion and the slide member passages are aligned respectively with the cover plate passages and in which each abutment member overlies a part of said base plate. In this manner, the contact elements are held captive in said passages when the slide member is in its second position.

In a first embodiment of the invention, the first housing member and the slide member are separate parts. In a second embodiment, the first and second housing members are unitary with each other and the cover plate is hingedly mounted on the first housing member and the slide member is hingedly mounted on the first housing member.

A more complete understanding of this invention will be obtained from the detailed description that follows taken with the accompanying drawings.

DESCRIPTION OF THE DRAWINGS

FIG. 4 shows a view taken on lines 4—4 of FIG. 2;

FIG. 5 shows the housing depicted in FIGS. 2 and 4, in a completely assembled state with a connecting device;

BEST MODE FOR CARRYING OUT THE INVENTION

A first embodiment of the coupling half unit 10 according to the invention comprises, as shown in FIGS. 4 and 5, a two-part housing 11,12 with a number of passages 13 parallel to one another, into each of which a contact element 20 is to be positioned as a unit.

Figure 3A:
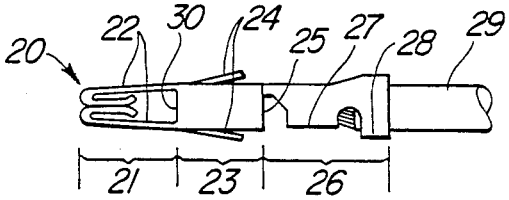
FIGS. 3A and 3B show a contact member which can be used in FIG. 2.
Figure 3B:
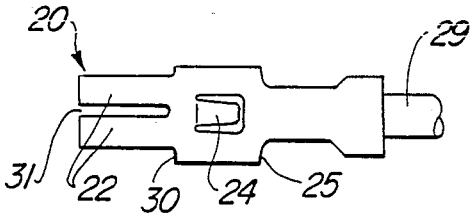

As is evident from FIG. 3A and FIG. 3B, the contact element 20 is divided into three parts. It comprises an initial part 21 with a contact 22, which consist here of a contact spring forming a female-shaped element. The element 20 also comprises a central holding part 23 with retaining tongues 24 and abutment shoulders 25, and an end part 26 with connecting elements 27,28 for receiving the end of an insulated electrical line 29. The contact element is constructed as a stamped piece of a sheet metal, in the initial part of which the contact springs 22 are divided into two spring parts by means of a longitudinal aperture 31. The mounting elements of the central part 23 include unitary retaining tongues 24 extending obliquely from the plane of the central part. The central part terminates in lateral shoulders 25 which adjoin the end part 26. The connecting elements on the end part 26 include bendable flap pairs 27,28, which respectively clamp the conductor of the line 29 and hold the insulated portion of the line for strain relief. At the transition point between the initial part 21 including the contact springs 22 and the central holding part 23, the contact element 20 is provided with stop shoulders 30 lying in the plane of illustration of FIG. 3B.

In the embodiment of FIGS. 1 through 5, a first housing member 11 in the form of a rectangular body is provided with a recess 14, for the insertion of the slide unit 12 forming second housing member. This recess 14 is closed on its internal end by a wall 15 as shown in FIG. 4. The recess intercepts the passages 13 along the passage axis 16 indicated by dotted lines in FIG. 4. This separates the passages 13 into two sections 17,18, of which the inlet section or cover plate passages 17 are positioned in a cover plate 32 of the housing 11 and the outlet section or base plate passages 18 are positioned in a base plate 33. Both the plates 32,33 are connected by lateral walls 34, and enclose the recess 14 with a rectangular aperture cross-section. The housing 11, like the slide unit 12, are produced separately from one another from insulating plastic by means of the injection molding process. The lateral walls 34 have on their external side integrally formed parts 35,36, which serve for the positioning of the complete housing 11,12 in a mounting unit, not shown.

The slide member or unit 12, comprises a number of slide member passages 19, which are disposed in a pattern corresponding to that of passages 13. The passages serve for the definitive positioning of the contact elements 20 which are to be inserted therein. For this purpose, the slide unit 12 is inserted, in the direction of the insertion arrow 37 of FIG. 1, into the recess 14 of the housing member 11, until the housing parts 11,12 are positioned as shown in FIG. 4 which is designated as the "pull-out position" or intermediate position of the slide unit 12. This pull-out position is determined by a latching means between the slide unit 12 and the housing member 11. The latching means comprises a pair of cams 38 and 38, and a keeper or bar 40 between an opening 39 in the housing cover plate 32 and the edge of the plate. The cams 38 and 38' and the bar 40 have a ramp surface inclined upwardly in the direction of the insertion arrow 37, which causes deformation of the cams 38 during the motion of the slide unit 12 until the bar 40 moves behind the steep surface of the cam 38. For the purpose of better guidance during the insertion 37 of the slide unit 12, it is provided with a longitudinal groove 78 which receives a guide rib (not shown) on the opposed wall of the recess 14 of the housing member 11.

In the pull-out position of the slide unit 12, the passage 19, as shown by the dotted center line 41 in FIG. 4, is aligned with the passage 42 where it extends through the plane 43 of the housing base plate 33. As depicted in FIG. 4, the contact elements 20 are inserted individually from the external side of the base plate 33 in the direction of the insertion arrow 44, until their stop shoulders 30 engage the shoulders 45 of the passage 19, and thus determine the axial insertion depth. When this position is reached, as shown in FIG. 5 the tongues 24 spread apart from one another, and engage the shoulders 46 provided in the passages 19 to interlock the contact elements 20 with the slide unit 12 and thereby inhibit removal of the contact elements 20. The axial position of each of the contact elements 20 is thereby determined in both directions. It is noted that the shoulders 30 and 45 for the different contact elements 20 all lie at the same level in the passages 19 and the same is true of the shoulders 46.

FIG. 5 shows an electrical component 50, which is provided with a counter-coupling unit 10'. This comprises complementary counter-contact elements 20', which are constructed here as plate-shaped rods or male elements which couple with the female-shaped contact springs 22. In addition, the counter-contact elements 20' must be inserted through the inlet sections or passages 17 in the housing cover plate 32. Through this, this inlet section or passage 17 is constructed as a channel 47, corresponding to the cross-section of the counter-contact elements 20', with which a funnel cone 48 equipped with insertion inclines is connected. In the pull-out position of FIG. 4, the center lines 41 of the passages 19 in the slide unit are offset or displaced relative to the axes 16 of the passages 13 by a distance 51. For this reason, the counter-coupling unit 10' cannot be successfully inserted into the coupling unit 10. The ends of the counter-coupling elements 20' engage parts of the wall 49 of the slide unit 12, which are positioned between the passages 19. The slide unit 12 may be inadvertently held in this pull-out position by improper insertion of the contact elements 20.

Even if the contact elements 20 are properly inserted in the passages 19, as shown in FIG. 5, they could be pushed out upon coupling with the counter-coupling elements 20' if the interlock provided by the locking tongue units 24 should fail or be omitted. In accordance with the invention, the slide unit 12 provides an additional interlock of the contact elements 20 to prevent undesired removal or extraction from the passages. Proceeding from the pull-out position of FIG. 4, the slide unit 12 needs only to be further pressed in the direction of the arrow 52 to move it into the position shown in FIG. 5, which is termed the operative or "push-in position". This moves the slide unit through the width 53 of a gap formed between the slide unit wall 54 and the housing wall 15. The wall 15 serves as a stop for the slide unit wall 54. The width 53 of the gap is the same as the distance 51 between the axis 16 and the line 41 of the passage 19. Accordingly, in the push-in position of FIG. 5, the passage inlet section or passages 17 are each precisely aligned with the passages 19 on the slide unit. The counter-contact elements 20' of the counter-coupling unit 10' depicted on the electrical component 50 of FIG. 5 can now be inserted smoothly into the coupling unit 10. The axial positions of the contact element 20 in the respective passage 19 is further secured by the following additional effects of the slide unit 12.

Figure 1:
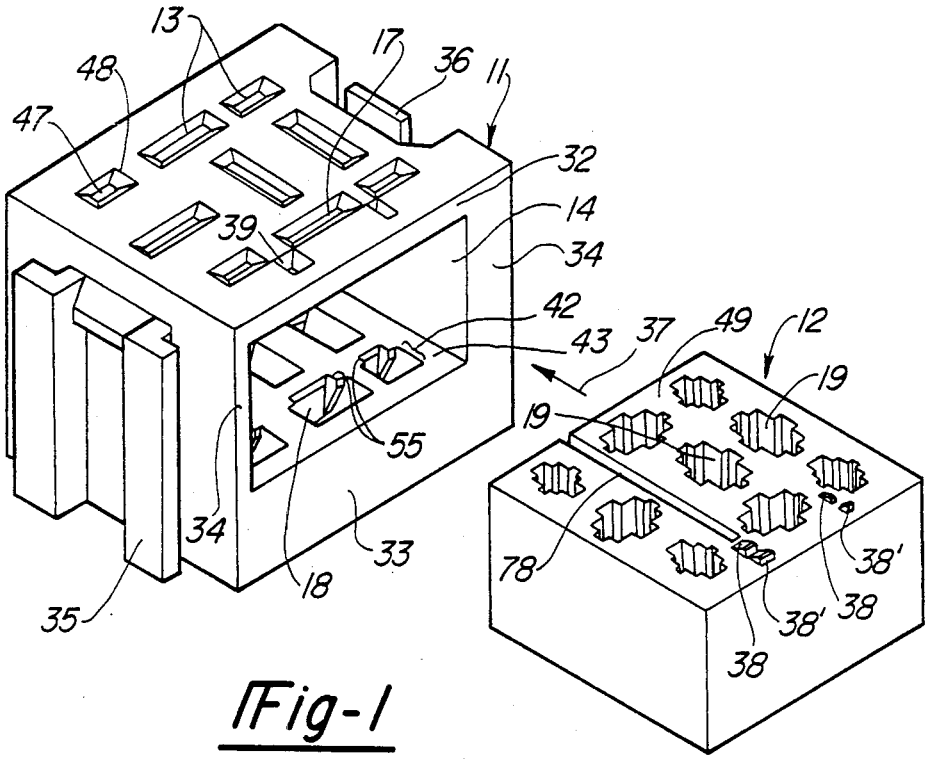
FIG. 1 shows a perspective representation of the housing in accordance with the invention, before assembly.
Figure 2:
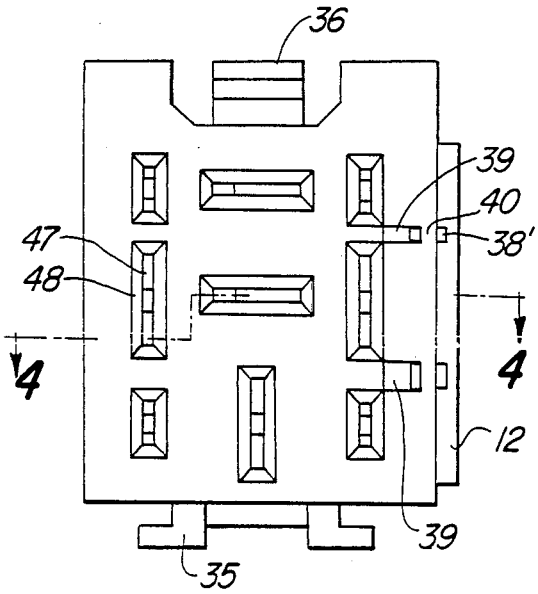
FIG. 2 shows a top view of both housing parts of FIG. 1 assembled in an intermediate stage.

When the slide unit 12 is moved to the push-in position as described above, it carries the contact elements 20 therein, and moves them into alignment with the inlet sections or passages 17. The slide unit 12 is therefore the transport agent for the contact elements 20. For this reason, the outlet section or passages 18 are provided with an enlarged width in the base plate 33. That is to say, the outlet section or passages 18 comprise lateral enlargements 58, which, in the lower part, produce a width greater than that of the opening 42. Thus the end parts 26 of the contact elements 20 are moved into the enlargements 58. The floor of the housing recess 14, as shown in FIG. 1, is provided with surfaces 55 which also constitute the upper surface of the base plate 33. Inclined surfaces 56 are formed in the base plate 33 adjacent the enlargements 58 and underlay the shoulder surfaces 55 and also facilitate the insertion movement 44 of the contact elements 20.

The push-in position of the slide unit 12 in FIG. 5 is secured by means of the second cams 38, of the latch means. When the slide unit is moved to the push-in position, the cams 38' move below the bar 40 at the openings 39, through an elastic deformation, and behind the bar on the internal side of the opening 39. Thus, the undesired extraction of the slide unit 12 is blocked. The aligned position of passages 19 with the axis 16 is ensured, and the contact elements 20 located therein are held in their proper position by means of the shoulder surfaces 55 of the housing base plate 33. The components of the coupling unit 10, in accordance with the invention, are secured to one another.

A second embodiment of the invention is depicted in FIGS. 6 to 9. It differs from the previous one in that all components of the housing are connected with one another, and are in particular constructed as a unitary body. For the sake of clarity, the same reference numbers as in the first embodiment are used for the designation of corresponding components.

Figure 6:
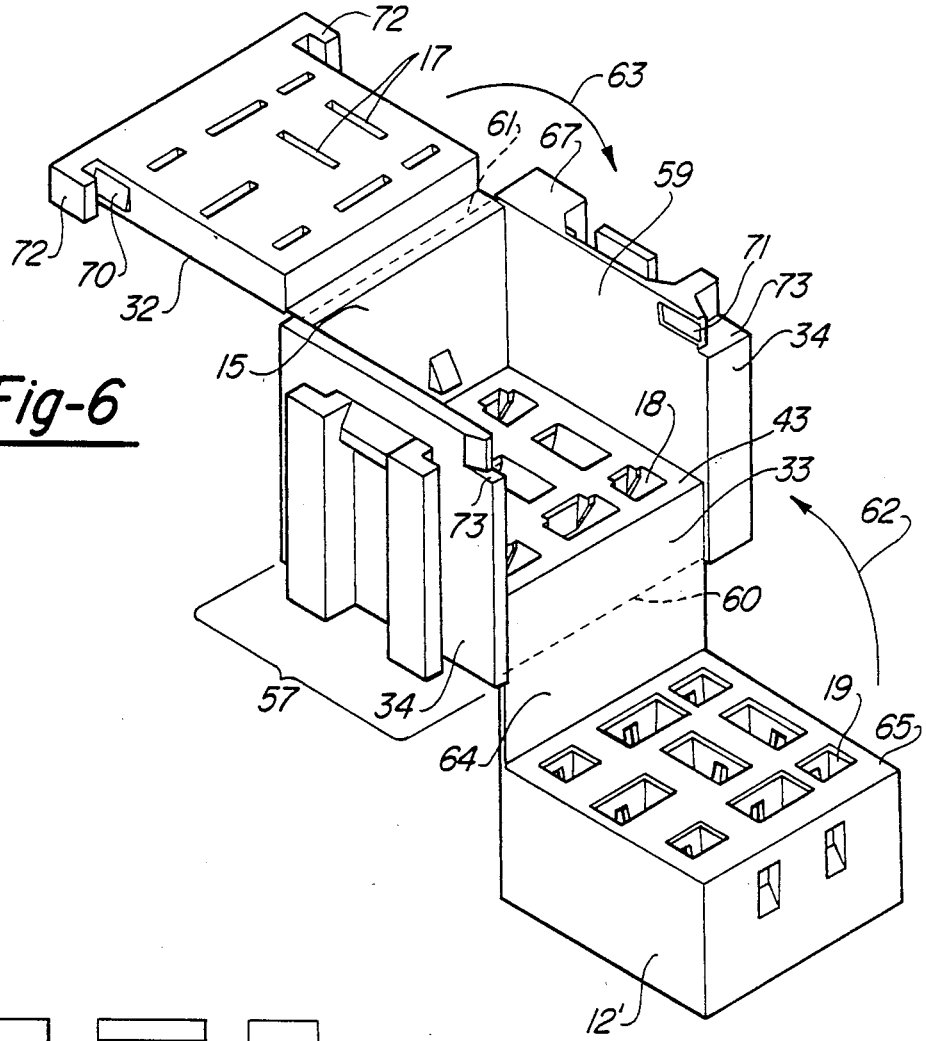
FIG. 6 shows another embodiment of the invention prior to assembly.
Figure 7:
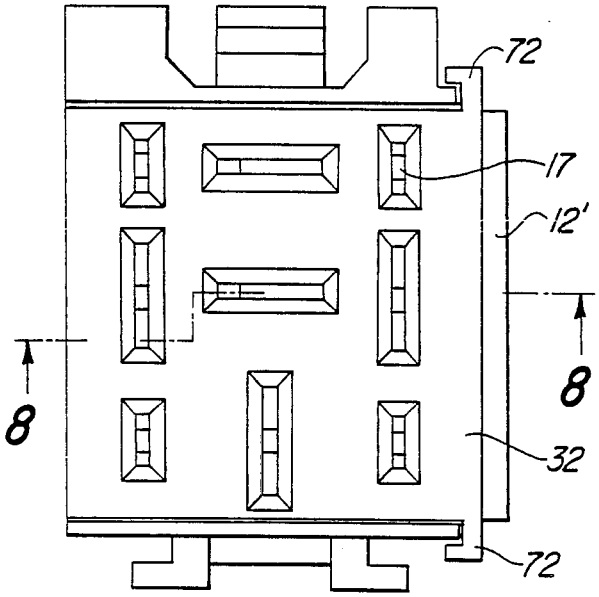
FIG. 7 is a top view showing the parts in an intermediate stage of assembly.

The housing in accordance with FIG. 6 consists of three different parts, which are movable as indicated by the arrows 62,63, namely a cover plate 32 with a casing housing 57 (forming a first housing member), and a second housing member or housing insert 12', which are connected with one another by means of hinges 60 and 61. The housing 57 comprises a base plate 33 with the outlet passages 18, a rear wall 15, as well as both lateral walls 34. The housing insert 12′ to be accommodated therein has the components of the previously described slide unit 12, that is, the longitudinally extending passages 19. The housing cover plate 32 is provided with inlet passages 17. All housing parts, together with the hinges 60,61, are produced in a single part from plastic with the hinges being constructed as thin flexible sheets. The hinge 60 for the housing insert 12′ is joined with the lower edge of the base plate 33 of the casing housing 57. It is connected with the housing insert 12′ by an extension plate 64. All components 32,57,12′ of the housing are thereby connected together and can be made simultaneously in a single mold with a cost-effective production method.

The housing insert 12′ is pivoted as indicated by arrow 62 into the internal space 59 of the casing housing 57, through which its side 65 pointing upwardly in FIG. 6, comes to rest on the upper surface 43 of the base plate 33. After that, the cover plate 32 is folded as indicated by arrow 63, into the internal space 59 of the casing housing 57. In this position the upper surface 66 of cover plate 32 is substantially flush with the upper edges 67 of the casing housing 57 at the lateral walls 34 and the rear wall 15. This folded position of the housing parts 12,,32 is secured by means of snap connections or detent elements 70,71. For this, the lateral edges of the cover plate 32 are provided with projection, L-shaped retaining members 72, which, upon folding down are seated on surface 73 of the housing lateral walls 34. The lateral edges of the cover plate 32 are provided with detent elements 70 in the form of ramp-shaped projections corresponding detent elements 71 of similar shape on the inner surface of walls 34. Thus the cover plate 32 is latched in a closed position and the housing insert 12′ is thereby latched in its folded position, as shown in FIG. 8.

Figure 8:
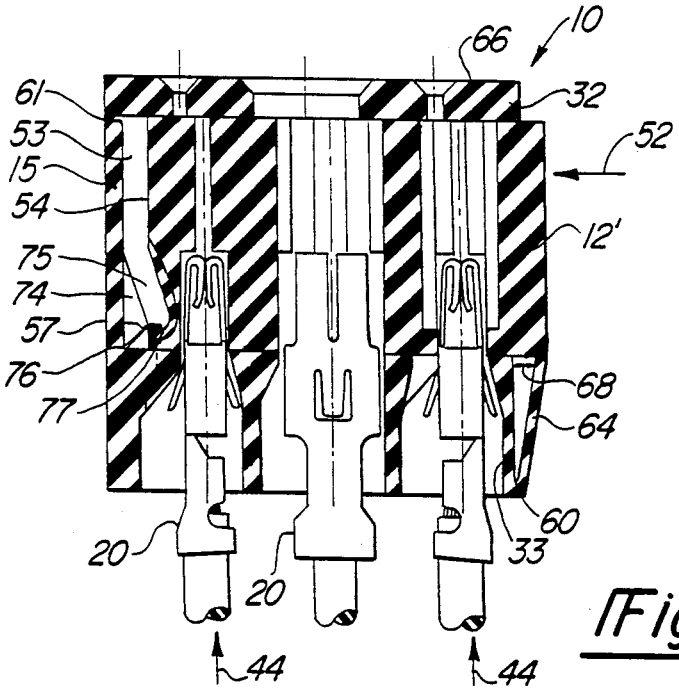
FIG. 8 is a view taken on lines 8—8 of FIG. 7.
Figure 9:
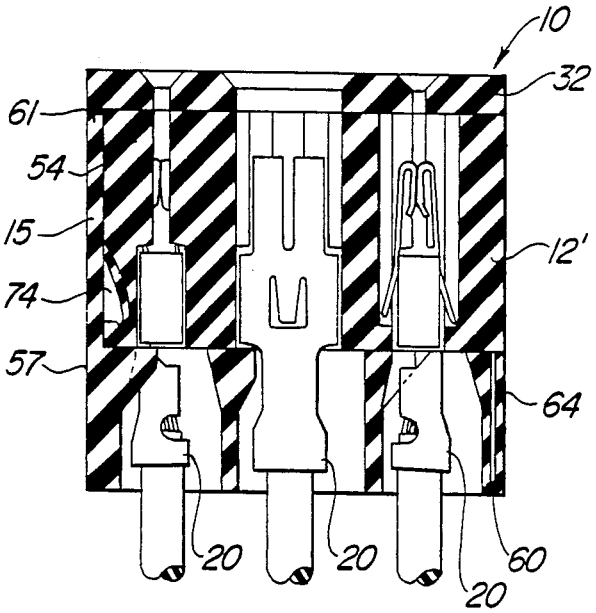
FIG. 9 shows the housing depicted in FIGS. 2 and 4, in a completely assembled state.

Apart from the diverging construction of the housing, as shown in FIG. 8, the same relations are present as were illustrated in the embodiment of FIG. 4; accordingly this intermediate position of the housing insert 12, can be termed its "pull-out position". Between the rear wall 15 of the housing 57 and the rear wall 54 of the insert 12′, there is a gap 53. Also adjacent the hinge 60 a gap 68 is provided between the plate 64 and the front surface of the housing base plate 33, which permits sliding of the housing insert 12′ in the direction of the arrow 52. The individual contact elements 20, are inserted into the passages in the direction of the arrow 44, until they have reached the final insertion depth as previously described and as shown in FIG. 9. Then the housing insert 12′ is moved to the push-in position as shown in FIG. 9 which corresponds to that shown in FIG. 5. In this insertion movement 52, the housing insert 12′ acts as a slide unit. It is moved inwardly until the rear wall 54 engages the rear wall 15 of the housing. The contact elements 20 are then interlocked with the base plate 33 to prevent retraction in the same manner as described with reference to FIG. 5. In this embodiment, a latch means is provided to hold the insert 12′ in the pull-out position and also in the push-in position. The latch means comprises, as shown in FIG. 8, a projection 74 on the internal surface of the rear wall 15. The projection is provided with a catch tooth 76 pointing downwardly. It also comprises a recess 75 on the rear wall 54 of the insert 12, The recess is formed with a groove 77 which coacts with the catch tooth 76. In the pull-out position of FIG. 8, the catch tooth 76 is engaged by the edge of recess 75 in the rear wall 54 of the insert 12′. In the push-in position, as shown in FIG. 9, the catch tooth 76 is disposed in the recess 75, under elastic deformation of the plastic material, and is seated in the groove 77. The pushing position is thereby latched and the contact elements 20 are held in proper position in the coupling half unit 10.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A multiple pole coupling comprising:

a first housing member having a base plate and a cover plate with a recess therebetween opening on one side of the housing member, a set of base plate passages and a corresponding set of cover plate passages extending longitudinally through said base plate and cover plate respectively, said sets of passages being disposed in the same pattern, the set of cover plate passages being laterally offset from the set of base plate passages, a second housing member including a slide member having a set of slide member passages extending therethrough and disposed in a pattern corresponding to that of said base plate and cover plate passages, said slide member being disposed in said recess in a first position with said slide member passages being aligned respectively with corresponding base plate passages, plural contact elements each being disposed partially in one of said base plate passages and partially in the corresponding one of said slide member passages, each of said contact elements having a laterally extending abutment member, each of said base plate passages having an enlarged portion adjacent the part of the respective contact element disposed therein, said slide member being movable in said recess to a second position in which said part of the contact element is disposed in said enlarged portion and said slide member passages are aligned respectively with said cover plate passages and each of said abutment members overlies a part of said base plate, whereby said contact elements are held captive in said passages.

2. A coupling as defined in claim 1 wherein said cover plate passages are blocked by said slide member in said first position.

3. A coupling as defined in claim 1 wherein the outside surface of said cover plate is provided with a conical recess surrounding each cover plate passage to facilitate the insertion of a contact element.

4. A coupling as defined in claim 1 wherein said abutment member comprises a shoulder on said contact element and said part of said base plate comprises the inner surface thereof.

5. A coupling as defined in claim 1 including latch means on said housing members for holding said slide member in said first and second positions.

6. A coupling as defined in claim 5 wherein said latch means comprises a pair of cams unitary with said slide member and an opening in said first housing member for coacting with said cams to hold said slide member in said first and second positions.

7. A coupling as defined in claim 1 wherein said first housing member and said slide member are separable from each other.

8. A coupling as defined in claim 1 wherein said first housing member and said second housing member are unitary with each other, said cover plate being hingedly mounted on the remainder of said first housing member and said slide member being hingedly mounted on said first housing member.

9. A coupling as defined in claim 1 wherein said slide member is provided with a unitary flat plate extending from one side thereof for a distance approximately equal to the thickness of said base plate and connected by a unitary hinge with the lower edge of said base plate, said slide member being pivotable about said unitary hinge to said first position, said slide member being movable by sliding motion from said first position to said second position.

10. A coupling as defined in claim 9 wherein said first housing member and said slide member are constructed of a unitary plastic body.

11. A coupling as defined in claim 8 wherein said first housing member comprises said base plate, a pair of side walls and a rear wall unitary with said base plate, said cover plate being unitary with said rear wall and hingedly mounted thereto and adapted to fold into a closed position in which said set of cover plate passages are laterally offset from said set of base plate passages, and including latching means for holding said cover plate in s id closed position.

12. A coupling unit as defined in claim 1 wherein said slide member is hingedly mounted on said first housing member and is slideably disposed between said base plate and said cover plate between said first position and said second position, and including latch means for holding said slide member in said second position.

* * * * *

UNITED STATES PATENT AND TRADEMARK OFFICE

CERTIFICATE OF CORRECTION

PATENT NO. : 4,846,737

DATED : July 11, 1989

INVENTOR(S) : Jorroch et al

It is certified that error appears in the above-identified patent and that said Letters Patent is hereby corrected as shown below:

Column 3, line 14, delete "38" (second instances) and insert --38'--.

Column 4, line 44, delete "38" and insert --38'--.

Column 5, line 27, delete "12,32" and insert --12',32--.

Line 67, delete "12" and insert --12'--.

Column 8, line 14, delete "s id" and insert --said--.

Signed and Sealed this

Fifteenth Day of December, 1992

*Attest:*

DOUGLAS B. COMER

*Attesting Officer*

*Acting Commissioner of Patents and Trademarks*